US006974186B1

(12) United States Patent
Chang

(10) Patent No.: US 6,974,186 B1
(45) Date of Patent: Dec. 13, 2005

(54) CHAIR

(76) Inventor: Horng Jiun Chang, P.O.Box 63-99, Taichung (TW) 406

( * ) Notice: Subject to any disclaimer, the term of this patent is extended or adjusted under 35 U.S.C. 154(b) by 0 days.

(21) Appl. No.: 10/884,469

(22) Filed: Jul. 3, 2004

(51) Int. Cl.[7] ..... A47C 1/02; A47C 20/00

(52) U.S. Cl. ..... 297/68; 297/69; 297/83; 297/423.19; 5/618

(58) Field of Search ..... 297/68, 69, 88, 297/89, 83, 84, 423.12, 423.19, 423.2; 5/617, 5/618

(56) References Cited

U.S. PATENT DOCUMENTS 3,858,938 A * 1/1975 Kristensson et al. ... 297/423.19
5,348,367 A * 9/1994 Mizelle ..... 297/83
5,792,082 A 8/1998 Yamanaka et al. ..... 601/148
6,022,071 A * 2/2000 Smith ..... 297/88
6,030,033 A * 2/2000 Schultz ..... 297/84
6,481,796 B1 * 11/2002 Chen ..... 297/329
6,572,185 B1 * 6/2003 Tseng ..... 297/85
6,604,791 B1 * 8/2003 Chen ..... 297/330
6,644,733 B1 * 11/2003 Tseng ..... 297/68
6,685,271 B1 2/2004 Chang ..... 297/423.4
6,692,078 B2 * 2/2004 Pham et al. ..... 297/423.2
2002/0101102 A1 * 8/2002 Chang ..... 297/330
2002/0105212 A1 * 8/2002 Nivet ..... 297/83
2005/0035632 A1 * 2/2005 Tseng ..... 297/83
2005/0035645 A1 * 2/2005 Tseng ..... 297/423.19

* cited by examiner

*Primary Examiner*—Peter R. Brown
*Assistant Examiner*—Sarah C. Burnham
(74) *Attorney, Agent, or Firm*—Alan D. Kamrath; Nikolai & Mersereau, P.A.

(57) ABSTRACT

A chair includes a seat rotatably attached to a base with a pivot axle and coupled to the base with an actuator, to adjust the seat relative to the base. A seat back is rotatably attached to the seat and coupled to the seat with another actuator, to adjust the seat back relative to the seat. A foot support is rotatably attached to the seat and coupled to the seat with a further actuator, to adjust the foot support relative to the seat. The seat is adjustable relative to the base, the seat back is adjustable relative to the seat, and the foot support is adjustable relative to the seat with different actuators. The foot support may include a foot pedal slidably coupled to a plate with another actuator.

7 Claims, 6 Drawing Sheets

CHAIR

BACKGROUND OF THE INVENTION

1. Field of the Invention

The present invention relates to a chair, and more particularly to a chair-type massage device having independent actuating or operating devices to actuate or to operate seats, seat backs, and foot supports.

2. Description of the Prior Art

Various kinds of typical chairs, such as chair-type massage devices have been developed for supporting users, and comprise a massage device disposed in or attached to seat backs of the chairs, for massaging back portions of the users.

For example, U.S. Pat. No. 5,792,082 to Yamanaka et al. discloses one of the typical chair-type massage devices, and comprise a seat back pivotally attached to a seat, and tiltable relative to the seat with an actuator, and a foot support pivotally or retractably attached to the seat with a linkage, for allowing the foot support to be extended out of the seat to an extending position, or moved toward the seat to a receiving or storing position.

The typical chair-type massage device also includes one or more massage devices disposed in or attached to the seat backs and/or the seats of the chairs, for massaging back portions and the buttocks of the users.

However, the seat may not be rotated or tilted or adjusted to the ground. The actuator for controlling the seat back should be actuated or operated with a handle, such that the users have to rotate or to force the handle relative to the chair, before the seat backs may be rotated or adjusted relative to the seats of the chairs. In addition, the foot support is also required to be actuated or operated with a handle before the foot support may be rotated or adjusted relative to the seat, such that the users may not relax their muscles to comfortably use the massage device.

U.S. Pat. No. 6,685,271 to the present application, Chang, discloses another typical chair-type massage device comprising a foot support pivotally or retractably attached to the seat with an actuator, and having a slidable foot pedal movable relative to the foot support with the actuator, in order to suitably support the feet of the users at selected positions. However, only the foot support may be easily adjusted relative to the seat. The seat back and the seat itself also may not be easily adjusted relative to the support base.

The present invention has arisen to mitigate and/or obviate the afore-described disadvantages of the conventional chairs.

SUMMARY OF THE INVENTION

The primary objective of the present invention is to provide a chair including independent actuating or operating devices to actuate or to operate seats, seat backs, and foot supports respectively.

In accordance with one aspect of the invention, there is provided a chair comprising a base, a seat rotatably attached to the base with a pivot axle, to allow the seat to be rotated relative to the base, a first actuator coupled between the seat and the base, to adjust the seat relative to the base, a seat back rotatably attached to the seat with a pivot shaft, to allow the seat back to be rotated relative to the seat, a second actuator coupled between the seat and the seat back, to adjust the seat back relative to the seat, a foot support rotatably attached to the seat with a pivot pole, to allow the foot support to be rotated relative to the seat, and a third actuator coupled between the foot support and the seat, to adjust the foot support relative to the seat. The seat is adjustable relative to the base, and the seat back is adjustable independently relative to the seat, and the foot support is adjustable independently relative to the seat.

The seat includes a frame extended therefrom, and a bar extended from the frame and coupled to the first actuator. The seat may further include another bar extended from the frame and coupled to the third actuator.

The foot support includes a plate having a bracket extended therefrom and coupled to the third actuator. The foot support includes a foot pedal slidably attached to the plate and movable relative to the plate.

The plate includes at least one track provided therein, the foot pedal is slidably attached to the plate with the at least one track. The foot support includes a fourth actuator coupled between the foot pedal and the plate, to adjust the foot pedal relative to the plate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
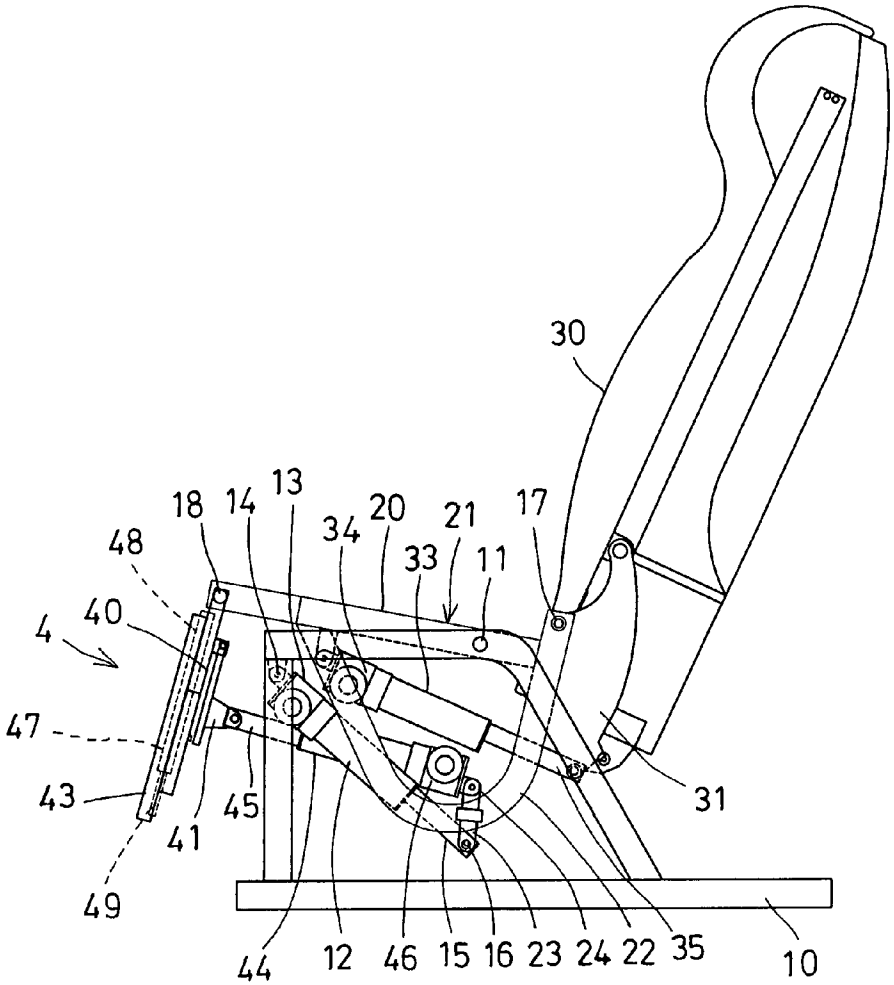
FIG. 1 is a side view of a chair in accordance with the present invention.
Figure 2:
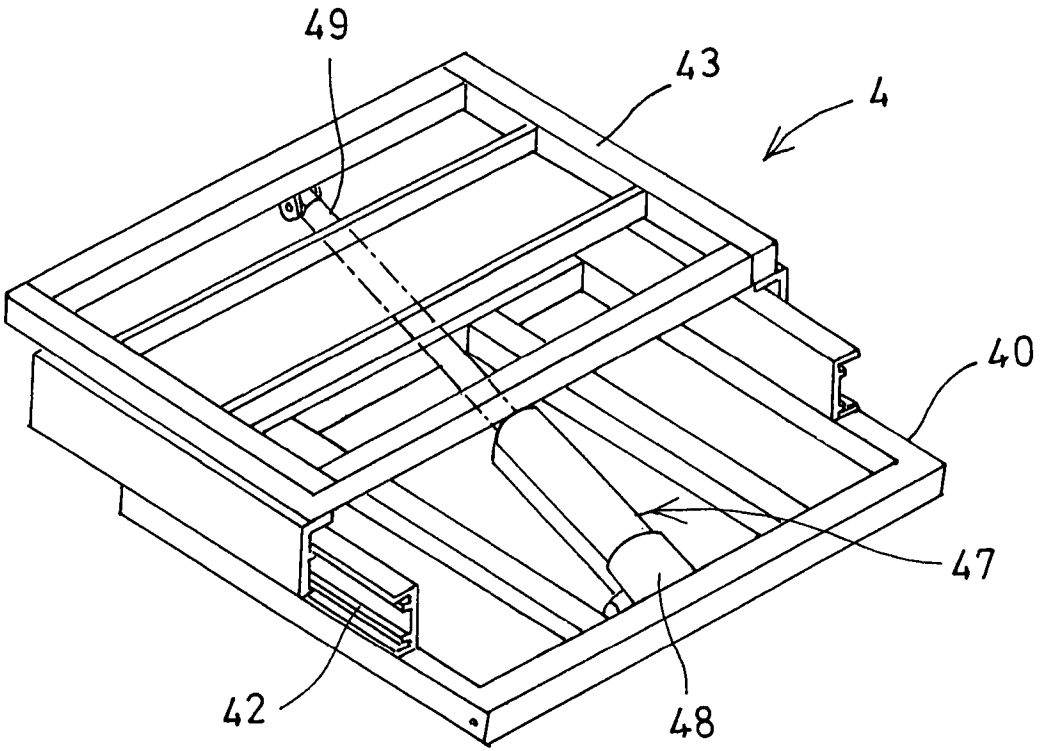
FIG. 2 is a perspective view illustrating a foot support for the chair.
Figure 3:
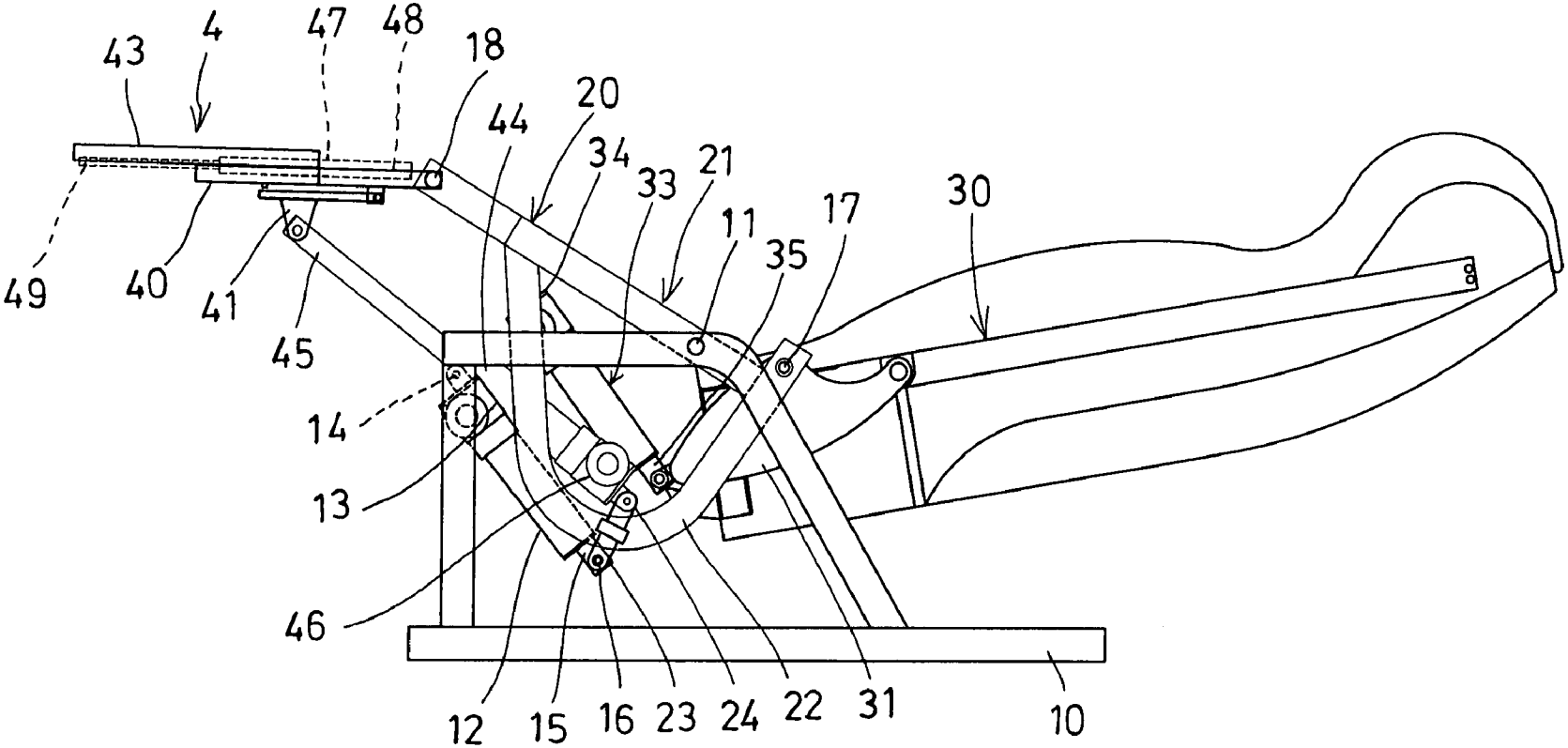
FIG. 3 is a side view similar to FIG. 1, illustrating the tilting operation of the seat relative to a supporting base.

Referring to the drawings, and initially to FIG. 1, a chair in accordance with the present invention is preferably a chair-type massage device, and comprises a supporting base 10 for stably engaging with and for being supported on ground, and a seat 20 rotatably or pivotally attached to the base 10 with a pivot axle 11, at a middle or rear portion 21 thereof, to allow the seat 20 to be rotated or adjusted relative to the base 10 (FIGS. 1, 3).

The seat 20 includes one or more, such as two frames 22 attached thereto, or extended downwardly therefrom, and preferably received in the base 10, and includes one or more, such as two bars 23, 24 attached thereto, or extended therefrom, and preferably provided in bottom portion of the frames 22, as shown in FIGS. 1 and 3–6.

A pneumatic or hydraulic cylinder or actuator 12 is coupled between the base 10 and the seat 20. For example, the actuator 12 includes one end 13 pivotally attached to the base 10 with a pivot pin 14 (FIGS. 1, 3), and the other end 15 pivotally attached to the bar 23 of the frame 22 of the seat 20 with a pivot pin 16 (FIGS. 1, 3–6), to allow the seat 20 to be easily rotated or adjusted relative to the base 10 with the actuator 12 (FIGS. 1, 3).

A seat back 30 includes a lower portion 31 rotatably or pivotally attached to the seat 20 with a pivot shaft 17, to allow the seat back 30 to be rotated or adjusted relative to the seat 20 (FIGS. 1, and 3–6). The seat back 30 may include a massage device disposed therein (not shown), for massaging the back portions of the users.

Another pneumatic or hydraulic cylinder or actuator 33 is coupled between the seat back 30 and the seat 20. For example, the actuator 33 includes one end 34 pivotally attached to the seat 20, and the other end 35 pivotally attached to the lower portion 31 of the seat back 30, to allow the seat back 30 to be easily rotated or adjusted relative to the seat 20 with the actuator 33.

Figure 4:
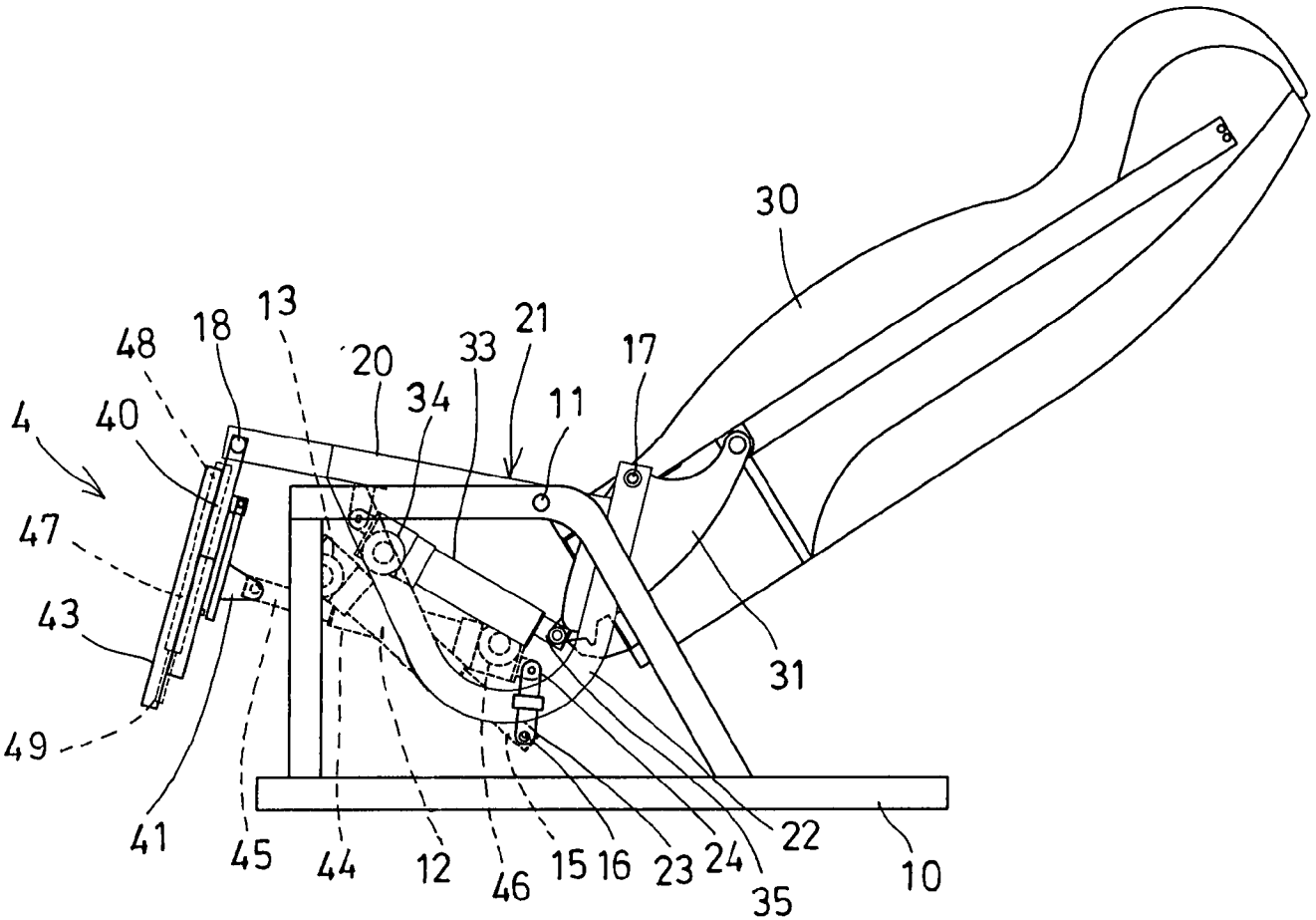
FIG. 4 is a side view similar to FIGS. 1, 3, illustrating the tilting operation of the seat back relative to the seat.
Figure 5:
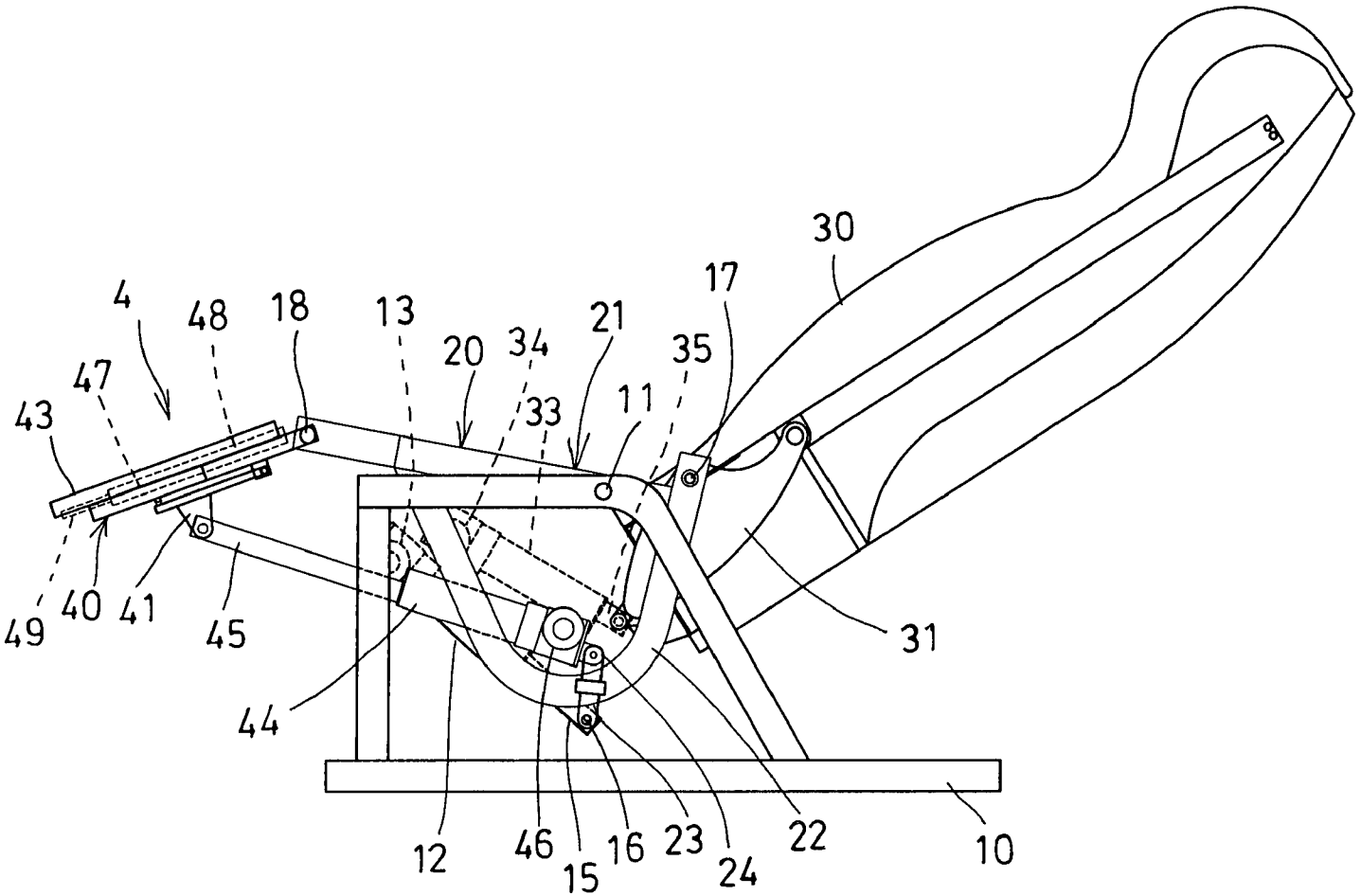
FIG. 5 is a side view similar to FIGS. 1, 3, 4, illustrating the tilting operation of the foot support relative to the seat.
Figure 6:
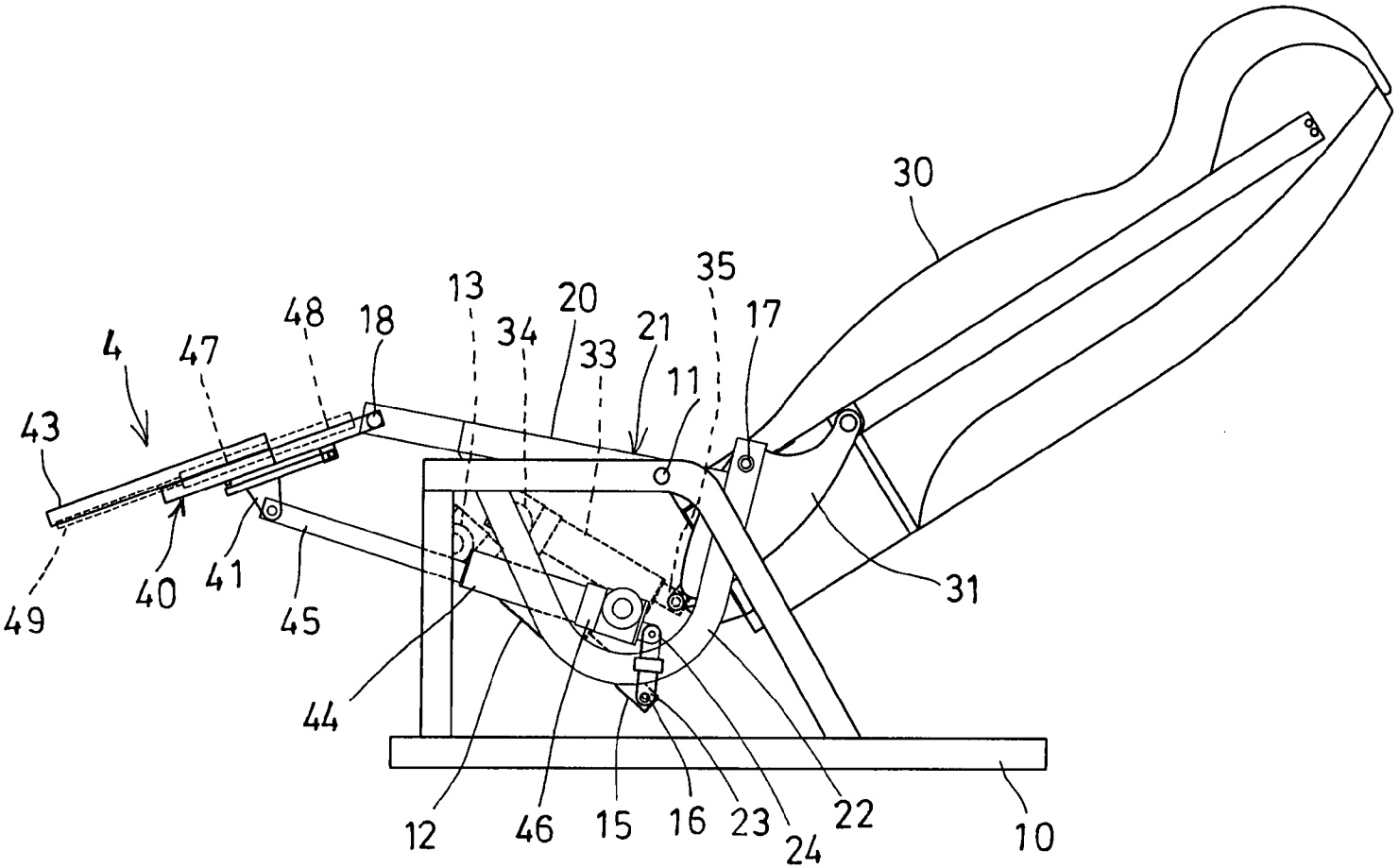
FIG. 6 is a side view similar to FIGS. 1 and 3–5, illustrating the extending operation of the foot support.

A foot support 4 includes a plate 40 rotatably or pivotally attached to the seat 20 with a pivot pin 18, to allow the foot support 4 to be rotated or adjusted relative to the seat 20 (FIGS. 1, 4; and 3, 5–6). The plate 40 includes a bracket 41 extended downwardly therefrom, and includes one or more, such as two tracks 42 provided thereon, to slidably attach a foot pedal 43 to the plate 40 with the tracks 43.

A further pneumatic or hydraulic cylinder or actuator 44 is provided and coupled between the plate 40 of the foot support 4 and the seat 20. For example, the actuator 44 includes one end 45 pivotally attached to the bracket 41 of the foot support 4, and the other end 46 pivotally attached to the bar 24 of the frame 22 of the seat 20, to allow the foot support 4 to be easily rotated or adjusted relative to the seat 20 with the actuator 44.

In addition, a still further pneumatic or hydraulic cylinder or actuator 47 may further be provided and coupled between the plate 40 and the foot pedal 43 of the foot support 4. For example, the actuator 47 includes one end 48 pivotally attached to the plate 45 of the foot support 4, and the other end 49 pivotally attached to the foot pedal 43, to allow the foot pedal 43 to be easily moved or adjusted relative to the plate 4 with the actuator 47.

It is to be noted that the seat 20 may be easily rotated or adjusted relative to the base 10 with the actuator 12, and the seat back 30 may be easily and independently rotated or adjusted relative to the seat 20 with the other actuator 33, and the foot support 4 may be easily and independently rotated or adjusted relative to the seat 20 with the further actuator 44, and the foot pedal 43 may be easily and independently moved or adjusted relative to the plate 4 with the still further actuator 47.

The chair thus includes a simplified control apparatus to adjust the base 10 relative to the actuator 12, and to adjust the seat back 30 relative to the seat 20, and to adjust the foot support 4 relative to the seat 20, and to adjust the foot pedal 43 relative to the plate 4 with different and independent actuators 12, 33, 44, 47, without interfering the adjustment of the other elements or members.

Accordingly, the chair in accordance with the present invention includes independent actuating or operating devices to actuate or to operate the seats, the seat backs, and the foot supports and/or the foot pedals respectively, without interfering the adjustment of the other elements or members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chair comprising:

a base, a seat rotatably attached to said base with a pivot axle, to allow said seat to be rotated relative to said base, a first actuator coupled between said seat and said base and having a first end pivotally connected to said base and a second end pivotally connected to said seat, to adjust said seat relative to said base, a seat back rotatably attached to said seat with a pivot shaft, to allow said seat back to be rotated relative to said seat, a second actuator coupled between said seat and said seat back and having a first end pivotally connected to said seat and a second end pivotally connected to said seat back, to adjust said seat back relative to said seat, a foot support rotatably attached to said seat with a pivot pin, to allow said seat foot support to be rotated relative to said seat, and a third actuator coupled between said foot support and said seat and having a first end pivotally connected to said foot support and a second end pivotally connected to said seat, to adjust said foot support relative to said seat, and said seat and said seat back being adjustable independently relative to said base, and said seat back being adjustable independently relative to said seat, and said foot support being adjustable independently relative to said seat.

2. The chair as claimed in claim 1, wherein said seat includes a frame extended therefrom, and a bar extended from said frame and coupled to said second end of said first actuator.

3. The chair as claimed in claim 1, wherein said foot support includes a frame-shaped plate rotatable mounted on said seat and having a bracket extended therefrom and pivotally connected to said first end of said third actuator.

4. The chair as claimed in claim 3, wherein said foot support includes a frame-shaped foot pedal slidably attached to said plate and movable relative to said plate.

5. The chair as claimed in claim 4, wherein said plate includes at least one track provided therein, said foot pedal is slidably mounted on and guide by said at least one track.

6. The chair as claimed in claim 4, wherein said foot support includes a fourth actuator coupled between said foot pedal and said plate and having a first end pivotally connected to said plate and a second end pivotally connected to said foot pedal, to adjust said foot pedal relative to said plate.

7. The chair as claimed in claim 1, wherein said seat includes a frame extended therefrom, and a bar extended from said frame and coupled to said second end of said third actuator.

* * * * *